US005850638A

United States Patent [19]

Her

[11] Patent Number: 5,850,638

[45] Date of Patent: Dec. 22, 1998

[54] TOILET VENTILATION SYSTEM

[76] Inventor: Tong X. Her, 4527 E. Belmont Ave., Fresno, Calif. 93702

[21] Appl. No.: 988,655

[22] Filed: Dec. 11, 1997

[51] Int. Cl.[6] ..... E03D 9/05

[52] U.S. Cl. ..... 4/213; 4/217

[58] Field of Search ..... 4/213, 217

[56] References Cited

U.S. PATENT DOCUMENTS

| | | | |
|---|---|---|---|
| 3,927,429 | 12/1975 | Pearson | 4/213 |
| 4,617,687 | 10/1986 | Wadsworth | 4/213 |

FOREIGN PATENT DOCUMENTS

| | | | |
|---|---|---|---|
| 919354 | 1/1973 | Canada | 4/213 |
| 1419782 | 12/1975 | United Kingdom | 4/213 |

*Primary Examiner*—David J. Walczak
*Assistant Examiner*—Tuan Nguyen

[57] ABSTRACT

A toilet ventilator system is provided including a ventilation housing having a C-shaped configuration defined by a top face, a bottom face, an inner side face, and an outer side face defining a constant square vertical cross-section along an entire length thereof. The top face of the housing is secured to the lower surface of the toilet seat with pair of closed spaced ends of the housing spaced from a center of a front portion of the toilet seat by an equal distance. The inner side face of the housing has a plurality of ventilation ports formed therein and spaced along a length thereof. Each port has a plurality of grouped apertures in communication with the interior space of the housing. A vacuum assembly is adapted to effect the suction of air from the inlet to the outlet upon actuation, whereby suctioned air passes through a scented filter situated within the vacuum assembly prior to exiting. A flexible tube is mounted between the ventilation housing and the inlet of the vacuum assembly for suctioning foul odor from the apertures of the ventilation ports of the ventilation housing.

1 Claim, 2 Drawing Sheets

TOILET VENTILATION SYSTEM

BACKGROUND OF THE INVENTION

1. Field of the Invention

The present invention relates to toilet fans and more particularly pertains to a new toilet ventilation system for removing odor from a toilet bowl.

2. Description of the Prior Art

The use of toilet fans is known in the prior art. More specifically, toilet fans heretofore devised and utilized are known to consist basically of familiar, expected and obvious structural configurations, notwithstanding the myriad of designs encompassed by the crowded prior art which have been developed for the fulfillment of countless objectives and requirements.

Known prior art toilet fans include U.S. Pat. No. 5,355,536; U.S. Pat. No. 5,010,600; U.S. Pat. No. 4,175,293; U.S. Pat. No. 4,780,913; U.S. Pat. No. Des. 344,788; and U.S. Pat. No. Des. 355,959.

In these respects, the toilet ventilation system according to the present invention substantially departs from the conventional concepts and designs of the prior art, and in so doing provides an apparatus primarily developed for the purpose of removing odor from a toilet bowl.

SUMMARY OF THE INVENTION

In view of the foregoing disadvantages inherent in the known types of toilet fans now present in the prior art, the present invention provides a new toilet ventilation system construction wherein the same can be utilized for removing odor from a toilet bowl.

The general purpose of the present invention, which will be described subsequently in greater detail, is to provide a new toilet ventilation system apparatus and method which has many of the advantages of the toilet fans mentioned heretofore and many novel features that result in a new toilet ventilation system which is not anticipated, rendered obvious, suggested, or even implied by any of the prior art toilet fans, either alone or in any combination thereof.

To attain this, the present invention generally comprises a toilet bowl having an upper peripheral edge with a front portion and a rear portion. A toilet seat is provided having an annular configuration hingably coupled to the rear portion of the upper peripheral edge of the bowl. As such, the toilet seat is adapted to pivot between a raised and lowered orientation. Associated therewith is a lid having planar closed circular configuration being pivotally coupled to the rear portion of the upper peripheral edge of the bowl. Similar to the seat, the lid is adapted to pivot between a raised and lowered orientation. Finally, a water basin is provided having a rectilinear configuration. The water basin is mounted to a rear of the toilet bowl. As shown in FIG. 1, the water basin has an upper peripheral edge. Further shown in FIG. 1 is a ventilation housing having a C-shaped configuration. The ventilation housing is defined by a top face, a bottom face an inner side face, and an outer side face defining a constant square vertical cross-section along an entire length thereof. The top face of the housing is secured to the lower surface of the toilet seat. A pair of closed spaced ends of the housing are spaced from a center of a front portion of the toilet seat by an equal distance. The inner side face of the housing has a plurality of ventilation ports formed therein and spaced along a length thereof. Each port has a plurality of grouped apertures in communication with the interior space of the housing. Next provided is a vacuum assembly having a planar inner face, an arcuate outer face, a top face, and a bottom face. The vacuum assembly further includes an inlet formed on the outer face. An outlet is formed on the bottom face. A thin hook is mounted on the top face and has a planar bottom portion situated in coplanar relationship with the inner face. A top portion of the hook defines a portion of a horizontally oriented cylinder for engaging the upper peripheral edge of the water basin. A thickness of the hook permits a cover associated with the basin to be mounted thereover. During operation, the vacuum assembly serves to effect the suction of air from the inlet to the outlet upon the actuation thereof. It should be noted that the suctioned air passes through a scented filter situated within the vacuum assembly prior to exiting. Mounted between the ventilation housing and the inlet of the vacuum assembly is a flexible tube for suctioning foul odor from the apertures of the ventilation ports of the ventilation housing. Finally, a push button momentary switch is mounted to the bottom face of the ventilation housing at one of the ends thereof. The switch is connected to the vacuum assembly via a wire situated within the interior space of the ventilation housing and the tube. The push button momentary switch serves to actuate the vacuum assembly only upon the depression thereof by a force. It is critical that such force be greater than that applied by a weight of the lid and seat in the lowered orientation thereof.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who arc not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new toilet ventilation system apparatus and method which has many of the advantages of the toilet fans mentioned heretofore and many novel features that result in a new toilet ventilation system which is not anticipated, rendered obvious, suggested, or even implied by any of the prior art toilet fans, either alone or in any combination thereof.

It is another object of the present invention to provide a new toilet ventilation system which may be easily and efficiently manufactured and marketed.

It is a further object of the present invention to provide a new toilet ventilation system which is of a durable and reliable construction.

An even further object of the present invention is to provide a new toilet ventilation system which is susceptible of a low cost of manufacture with regard to both materials and labor, and which accordingly is then susceptible of low prices of sale to the consuming public, thereby making such toilet ventilation system economically available to the buying public.

Still yet another object of the present invention is to provide a new toilet ventilation system which provides in the apparatuses and methods of the prior art some of the advantages thereof, while simultaneously overcoming some of the disadvantages normally associated therewith.

Still another object of the present invention is to provide a new toilet ventilation system for removing odor from a toilet bowl.

Even still another object of the present invention is to provide a new toilet ventilation system that includes a ventilation housing having a C-shaped configuration defined by a top face, a bottom face, an inner side face, and an outer side face defining a constant square vertical cross-section along an entire length thereof. The top face of the housing is secured to the lower surface of the toilet seat with pair of closed spaced ends of the housing spaced from a center of a front portion of the toilet seat by an equal distance. The inner side face of the housing has a plurality of ventilation ports formed therein and spaced along a length thereof. Each port has a plurality of grouped apertures in communication with the interior space of the housing. A vacuum assembly is adapted to effect the suction of air from the inlet to the outlet upon actuation, whereby suctioned air passes through a scented filter situated within the vacuum assembly prior to exiting. A flexible tube is mounted between the ventilation housing and the inlet of the vacuum assembly for suctioning foul odor from the apertures of the ventilation ports of the ventilation housing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
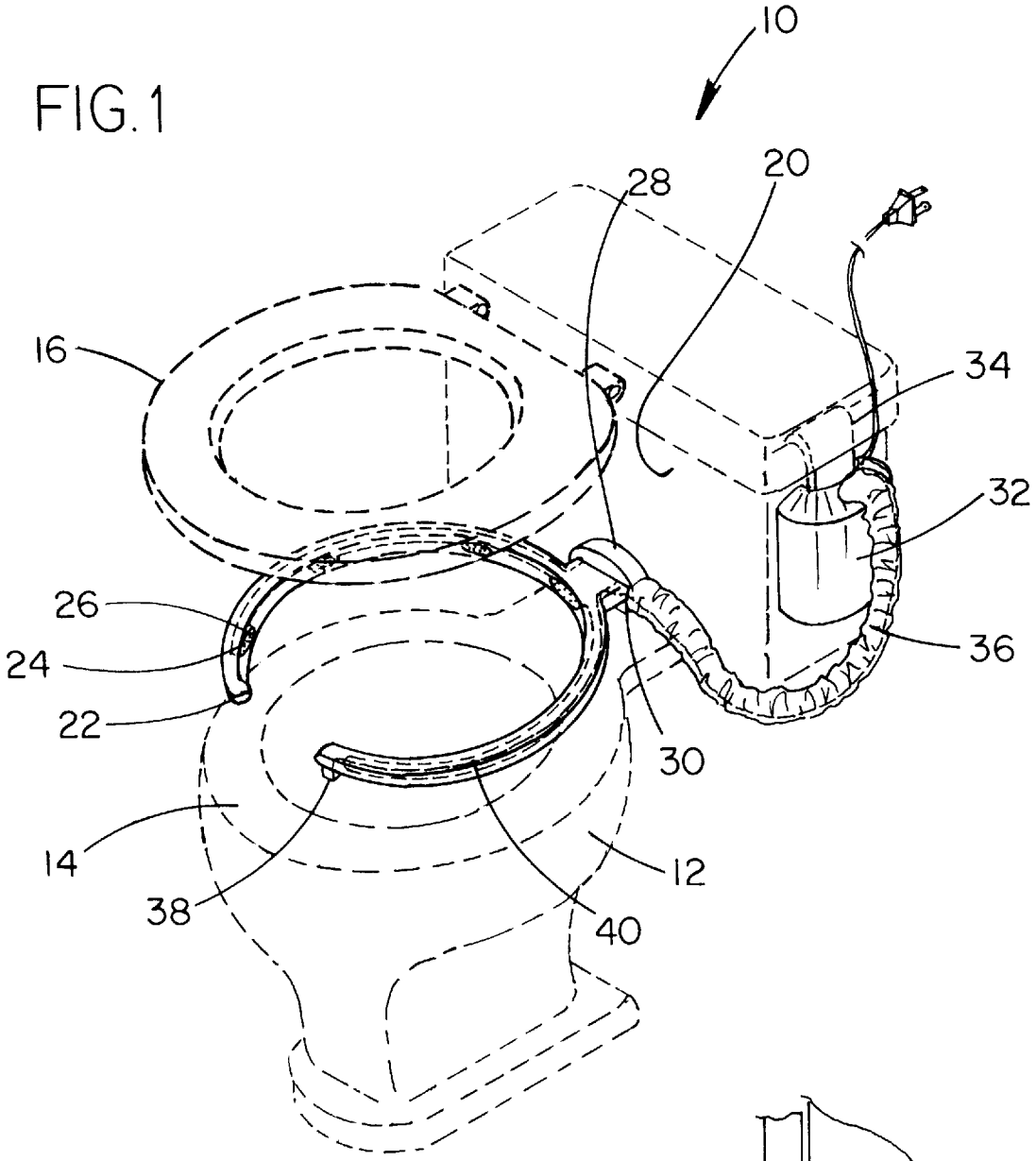
FIG. 1 is a perspective view of a new toilet ventilation system according to the present invention.
Figure 2:
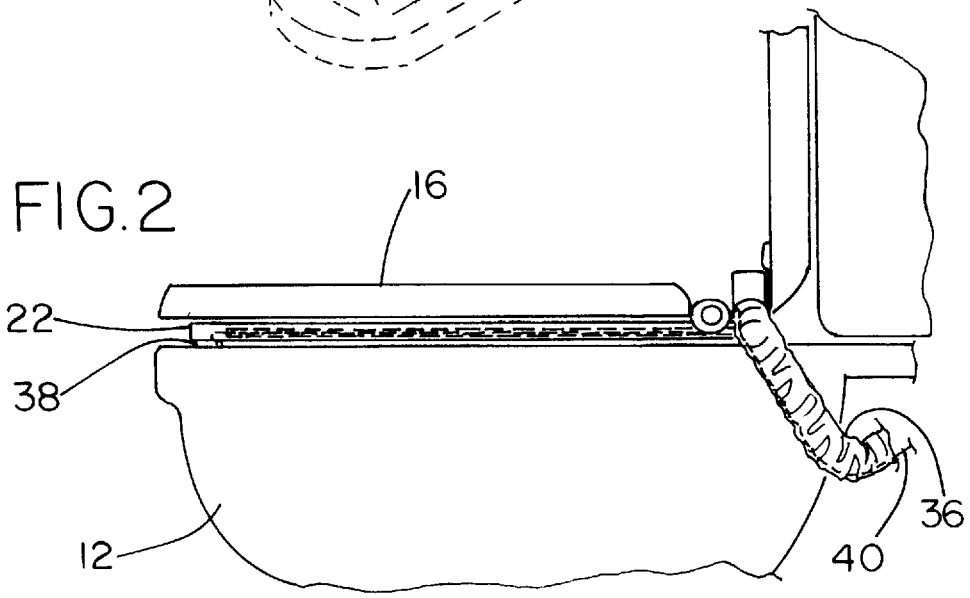
FIG. 2 is a side view of the present invention.

With reference now to the drawings, and in particular to FIGS. 1 through 4 thereof, a new toilet ventilation system embodying the principles and concepts of the present invention and generally designated by the reference numeral 10 will be described.

The present invention, designated as numeral 10, includes a toilet bowl 12 having an upper peripheral edge 14 with a front portion and a rear portion. A toilet seat 16 is provided having an annular configuration and hingably coupled to the rear portion of the upper peripheral edge of the bowl. As such, the toilet seat is adapted to pivot between a raised and lowered orientation. Associated therewith is a lid having planar closed circular configuration being pivotally coupled to the rear portion of the upper peripheral edge of the bowl. Similar to the seat, the lid is adapted to pivot between a raised and lowered orientation. Finally, a water basin 20 is provided having a rectilinear configuration. The water basin is mounted to a rear of the toilet bowl. As shown in FIG. 1, the water basin has an upper peripheral edge.

Further shown in FIG. 1 is a ventilation housing 22 having a C-shaped configuration. The ventilation housing is defined by a top face, a bottom face, an inner side face, and an outer side face defining a constant square vertical cross-section along an entire length thereof. The top face of the housing is secured to the lower surface of the toilet seat. A pair of closed spaced ends of the housing are spaced from a center of a front portion of the toilet seat by an equal distance. In the preferred embodiment, the closed ends are spaced between 30–45 degrees. It should be noted that the ventilation housing serves a purpose similar to that of bumpers of normal toilet seats.

The inner side face of the housing has a plurality of ventilation ports 24 formed therein and spaced along a length thereof. Each port has a plurality of grouped apertures 26 in communication with the interior space of the housing. There are preferably about six ventilation ports each equally spaced along the inner face of the ventilation housing. As shown in FIG. 1, a rear portion 28 of the ventilation housing has a rectangular mounting adapter formed in coplanar relationship therewith. The mounting adapter has an aperture 30 formed on a side face thereof. It is imperative that the rectangular mounting adapter have a width which is less than a spacing between mounting arms of the toilet seat. Further, it must be of sufficient flexibility and resilience for accommodating the pivoting nature of the toilet seat.

Next provided is a vacuum assembly 32 having a planar inner face, an arcuate outer face, a top face, and a bottom face. The vacuum assembly further includes an inlet formed on the outer face. An outlet is formed on the bottom face. A thin hook 34 is mounted on the top face and has a planar bottom portion situated in coplanar relationship with the inner face. A top portion of the hook defines a portion of a horizontally oriented cylinder for engaging the upper peripheral edge of the water basin. A thickness of the hook permits a cover associated with the basin to be mounted thereover.

During operation, the vacuum assembly serves to effect the suction of air from the inlet to the outlet upon the actuation thereof. It should be noted that the suctioned air passes through an unillustrated scented filter situated within the vacuum assembly prior to exiting. For powering the vacuum assembly, a rechargeable battery is preferably situated therein.

Mounted between the ventilation housing and the inlet of the vacuum assembly is a flexible tube 36 for suctioning foul odor from the apertures of the ventilation ports of the ventilation housing. The flexible tube preferably includes a flexible sheath situated about a resilient wire frame for maintaining the shape of the tube during use.

Finally, a push button momentary switch 38 is mounted to the bottom face of the ventilation housing at one of the ends thereof. The switch is connected to the vacuum assembly via a wire 40 situated within the interior space of the ventilation housing and the tube. The push button momentary switch serves to actuate the vacuum assembly only upon the depression thereof by a force. It is critical that such force be greater than that applied by a weight of the lid and seat in the lowered orientation thereof. To accomplish this, the push button momentary switch preferably has a spring positioned therein with a sufficient spring constant.

Figure 3:
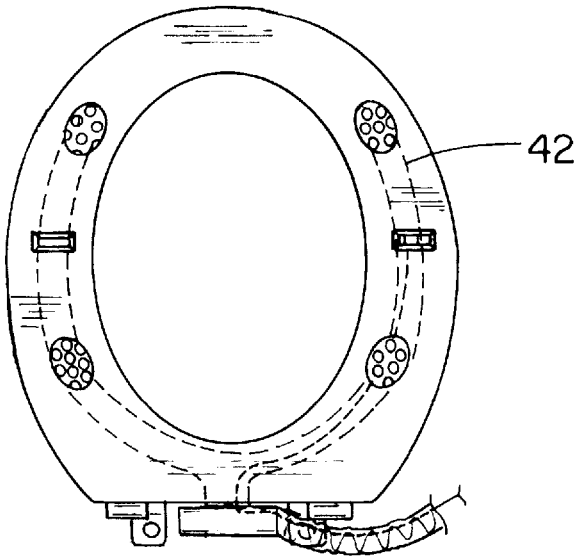
FIG. 3 is a bottom view of the seat of the alternate embodiment of the present invention.
Figure 4:
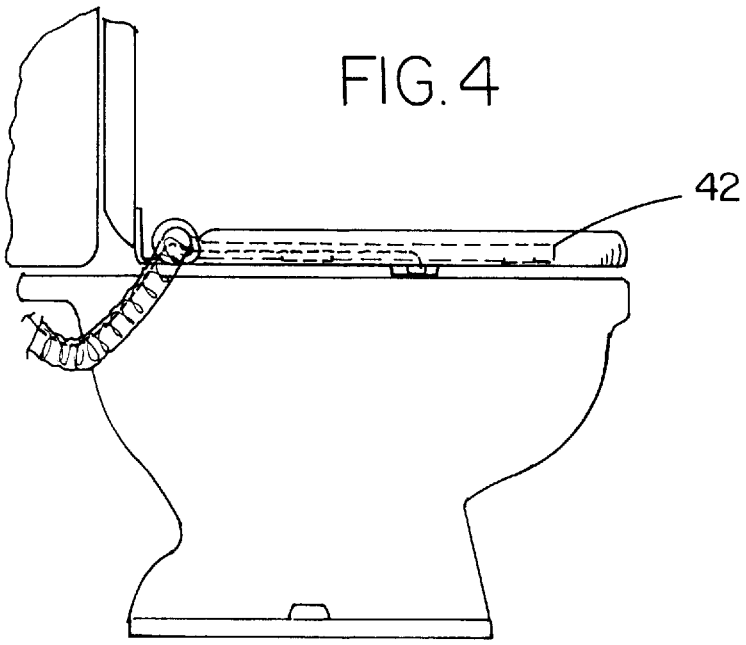
FIG. 4 is a side view of the embodiment of the present invention shown in FIG. 3.

As shown in FIGS. 3 & 4, the retrofittable ventilation housing is replaced with a seat with a ventilation housing 42 mounted therein at time of manufacture. In the present embodiment, the ventilation ports are mounted to a lower surface of the seat with the seat being equipped with a elevating bumpers. The momentary switch of the present embodiment is also mounted on the lower surface of the seat.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toilet ventilator system for use with a toilet bowl having an upper peripheral edge with a front portion and a rear portion, a toilet seat having an annular configuration hingably coupled to the rear portion of the upper peripheral edge of the bowl and adapted to pivot between a raised and lowered orientation, and a water basin having a rectilinear configuration and mounted to a rear of the toilet bowl with the water basin having an upper peripheral edge, the system comprising:

a ventilation housing having a C-shaped configuration defined by a top face, a bottom face, an inner side face, and an outer side face defining a constant square vertical cross-section along an entire length thereof, the top face of the housing secured to the lower surface of the toilet seat with pair of closed spaced ends of the housing spaced from a center of a front portion of the toilet seat by an equal distance for acting as a bumper between the toilet seat and the upper peripheral edge of the toilet bowl, the inner side face of the housing having a plurality of ventilation ports formed therein and spaced along a length thereof, each port having a plurality of grouped apertures in communication with the interior space of the housing wherein a rear portion of the ventilation housing has a rectangular mounting adapter formed in coplanar relationship therewith and has an aperture formed on a side face thereof, the rear portion having a width which is less than a spacing between mounting arms of the toilet seat;

a vacuum assembly having a planar inner face, an arcuate outer face, a top face, and a bottom face, the vacuum assembly further including an inlet formed on the outer face, an outlet formed on the bottom face, a thin hook mounted on the top face and having a planar bottom portion situated in coplanar relationship with the inner face and a top portion defining a portion of a horizontally oriented cylinder for engaging the upper peripheral edge of the water storage basin for suspending the vacuum assembly from the water storage basin above and off of the floor supporting the toilet, the vacuum assembly adapted to effect the suction of air from the inlet to the outlet upon the actuation thereof, whereby suctioned air passes through a scented filter situated within the vacuum assembly prior to exiting;

a flexible tube mounted between the aperture of the rear portion of the ventilation housing and the inlet of the vacuum assembly for suctioning foul odor from the apertures of the ventilation ports of the ventilation housing, the flexible tube including a resilient wire with a flexible sheath situated thereon; and a push button momentary switch mounted to the bottom face of the ventilation housing at one of the ends thereof, the switch connected to the vacuum assembly via a wire situated within the interior space of the ventilation housing and the tube, the push button momentary switch adapted to actuate the vacuum assembly only upon the depression thereof by a force greater than that applied by a weight of the lid and seat in the lowered orientation thereof.

* * * * *